US006789583B2

(12) United States Patent
Tanaka et al.

(10) Patent No.: US 6,789,583 B2
(45) Date of Patent: Sep. 14, 2004

(54) GAS SUPPLY APPARATUS AND GAS SUPPLY METHOD

(75) Inventors: Junichi Tanaka, Yokohama (JP); Takashi Orita, Ryuo-cho (JP); Makoto Echigojima, Kamakura (JP)

(73) Assignee: Nippon Sanso Corporation, Tokyo (JP)

( * ) Notice: Subject to any disclaimer, the term of this patent is extended or adjusted under 35 U.S.C. 154(b) by 0 days.

(21) Appl. No.: 10/353,914

(22) Filed: Jan. 30, 2003

(65) Prior Publication Data

US 2003/0145902 A1 Aug. 7, 2003

(30) Foreign Application Priority Data

Feb. 1, 2002 (JP) ..... 2002-025540

(51) Int. Cl.[7] ..... F28F 9/22
(52) U.S. Cl. ..... 141/82; 165/80.1; 126/261
(58) Field of Search ..... 141/82, 98, 192, 141/198; 165/80.1; 126/261, 262

(56) References Cited

U.S. PATENT DOCUMENTS 2,595,685 A * 5/1952 Mallory ..... 165/120
4,402,304 A * 9/1983 Corey ..... 126/343.5 A
6,029,741 A * 2/2000 Yokogi et al. ..... 165/80.1

FOREIGN PATENT DOCUMENTS

JP 11-166697 12/1998

* cited by examiner

*Primary Examiner*—Steven O. Douglas
(74) *Attorney, Agent, or Firm*—Nixon & Vanderhye P.C.

(57) ABSTRACT

This gas supply apparatus supplies a gas by vaporizing a liquefied gas filled in a gas container. This apparatus includes an installation stand having an upper surface on which the gas container is placed; at least one nozzle which discharges a beating medium towards a bottom surface of the gas container and is provided in a hole formed in the installation stand; and a heating medium discharge path which discharges the heating medium from a space between the bottom surface of the gas container and the upper surface of the installation stand.

4 Claims, 8 Drawing Sheets

GAS SUPPLY APPARATUS AND GAS SUPPLY METHOD

This application claims priority under 35 U.S.C. §119 and/or 365 to 2002-025540 filed in Japan on Feb. 1, 2002; the entire content of which is hereby incorporated by reference.

BACKGROUND OF THE INVENTION

1. Field of the Invention

The present invention relates to a gas supply apparatus and method, and more particularly, to a gas supply apparatus and method capable of efficiently supplying a liquefied gas filled into a gas container in a stable state by vaporizing the liquefied gas within the gas container.

2. Background Art

Gas such as $WF_6$, $ClF_3$, $BCl_3$ and $SiH_2Cl_2$ used in the field of semiconductor production and so forth are filled and stored in gas containers in a liquid state at normal temperature (liquefied gas state), and when these gases are used, the gas container is heated from the outside as necessary to promote vaporization of the liquefied gas within the gas container.

In addition, in the supplying of such gases, although it is necessary to maintain the pressure of supplied gas led out from the gas container at a roughly constant pressure close to a set pressure, in the past, the pressure inside the gas container or the pressure of a gas supply line connected to it was measured, and the amount of heating of the gas container was regulated based on that change in pressure. However, in the case of controlling the pressure using only this type of pressure feedback, due to the low responsiveness, there are times when it becomes difficult to attain stable control in cases of large fluctuations in the amount of gas supplied, and, in particular, during the initial supply of gas when the pressure inside the gas container is low, there was the problem of a long period of time being required until the pressure stabilized. Moreover, in the case of supplying gas from a gas container, it is also necessary to reliably determine the time when the gas container is to be replaced by detecting the residual amount of gas in the gas container.

The object of the present invention is to provide a gas supply apparatus and method, which together with being able to efficiently heat or cool a gas container from the outside, is able to maintain the pressure of supplied gas roughly constant, while also being able to reliably detect the residual amount of gas in the gas container.

SUMMARY OF THE INVENTION

The gas supply apparatus of the present invention supplies a gas by vaporizing a liquefied gas filled in a gas container. This apparatus comprises an installation stand having an upper surface on which the gas container is placed; at least one nozzle which discharges a heating medium towards a bottom surface of the gas container and is provided in a hole formed in the installation stand; and a heating medium discharge path which discharges the heating medium from a space between the bottom surface of the gas container and the upper surface of the installation stand.

According to the gas supply apparatus, since liquefied gas filled into a gas container can be supplied by evaporating and vaporizing the liquefied gas efficiently, and the supply pressure can be stabilized, gas supply can be carried out in a stable state.

The heating medium discharge path may be at least one through hole provided in the installation stand.

The heating medium discharge path may be formed by surface irregularities provided in the upper surface of the installation stand.

The gas supply apparatus may further comprise a cylindrical cover that covers the periphery of the gas container, and the heating medium discharge path may be formed so that heating medium discharged from the nozzle flows into a gap between the gas container and the cylindrical cover.

The installation stand may be supported by a weighing device capable of measuring changes in the weight of the gas container, and the nozzle may be provided in a non-contact state with respect to the installation stand.

The gas supply apparatus may further comprise a pressure measuring device which measures the pressure of gas supplied from the gas container; a flow rate measuring device which measures the flow rate of the gas; and a temperature regulating device which regulates the temperature of the heating medium based on measured values of the pressure measuring device and the flow rate measuring device.

The gas supply method of the present invention comprises supplying a vaporized gas while heating or cooling a gas container into which liquefied gas has been filled by a heating medium; measuring the pressure and flow rate of the vaporized gas flowing out from the gas container; regulating the temperature of the heating medium based on the difference between the measured flow rate of the vaporized gas and a reference flow rate when the measured flow rate is outside an allowed range of flow rate fluctuation predetermined with respect to a reference flow rate, and regulating the temperature of the heating medium based on the difference between the measured pressure and a reference pressure when the measured flow rate is within the allowed range of flow rate fluctuation relative to the reference flow rate.

Another aspect of the gas supply method comprises supplying a vaporized gas while heating or cooling a gas container into which liquefied gas has been filled by a heating medium; measuring the pressure and flow rate of the vaporized gas flowing out from the gas container; regulating the temperature of the heating medium based on the difference between the measured flow rate and a reference flow rate when the measured pressure is lower than a lower limit pressure predetermined with respect to a reference pressure, and regulating the temperature of the beating medium based on the difference between the measured pressure and a reference pressure when the measured pressure is equal to or greater than the lower limit pressure.

BEST MODE FOR CARRYING OUT THE INVENTION

Figure 1:
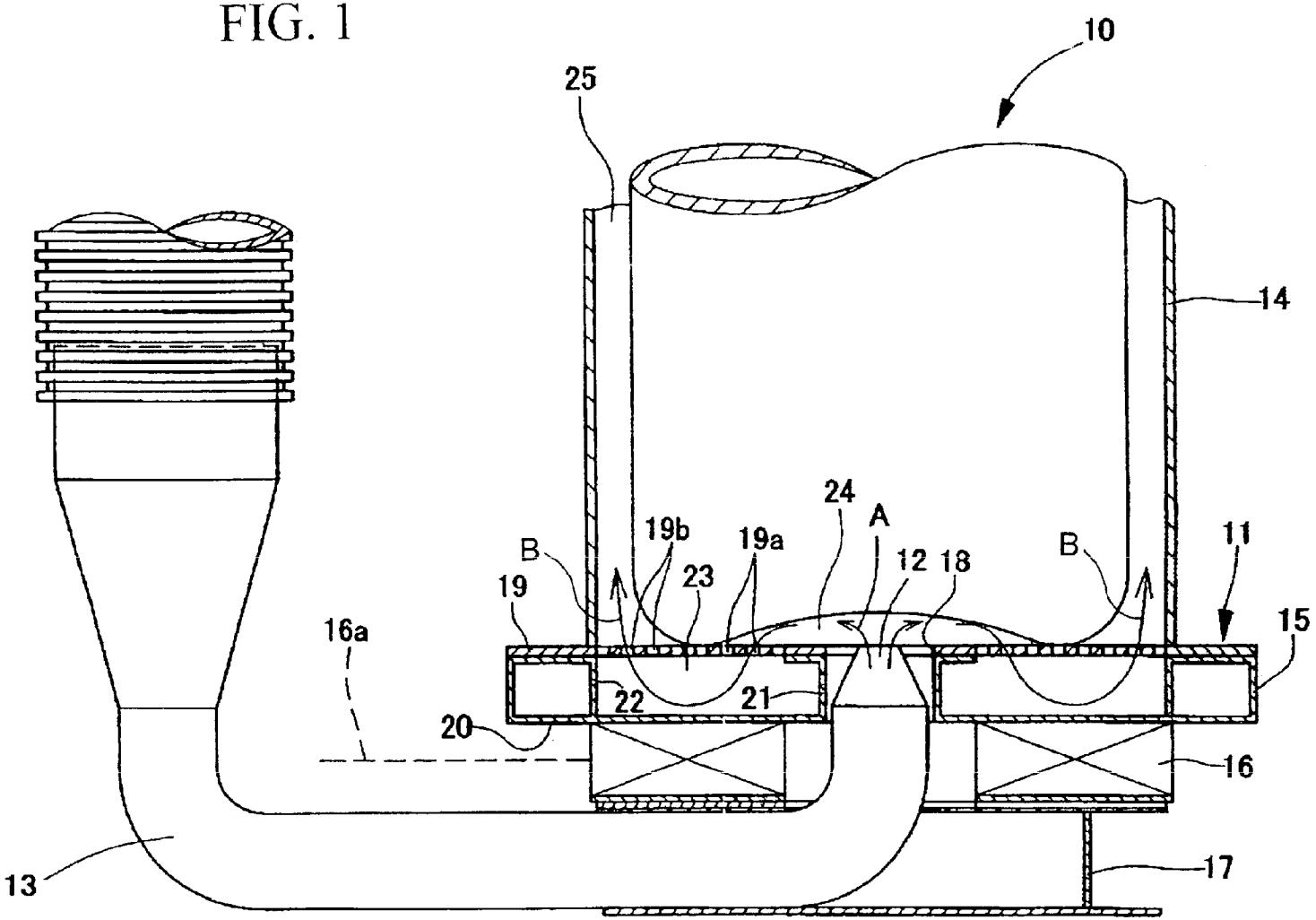
FIG. 1 is a cross-sectional front view showing a first embodiment of the gas supply apparatus of the present invention.
Figure 2:
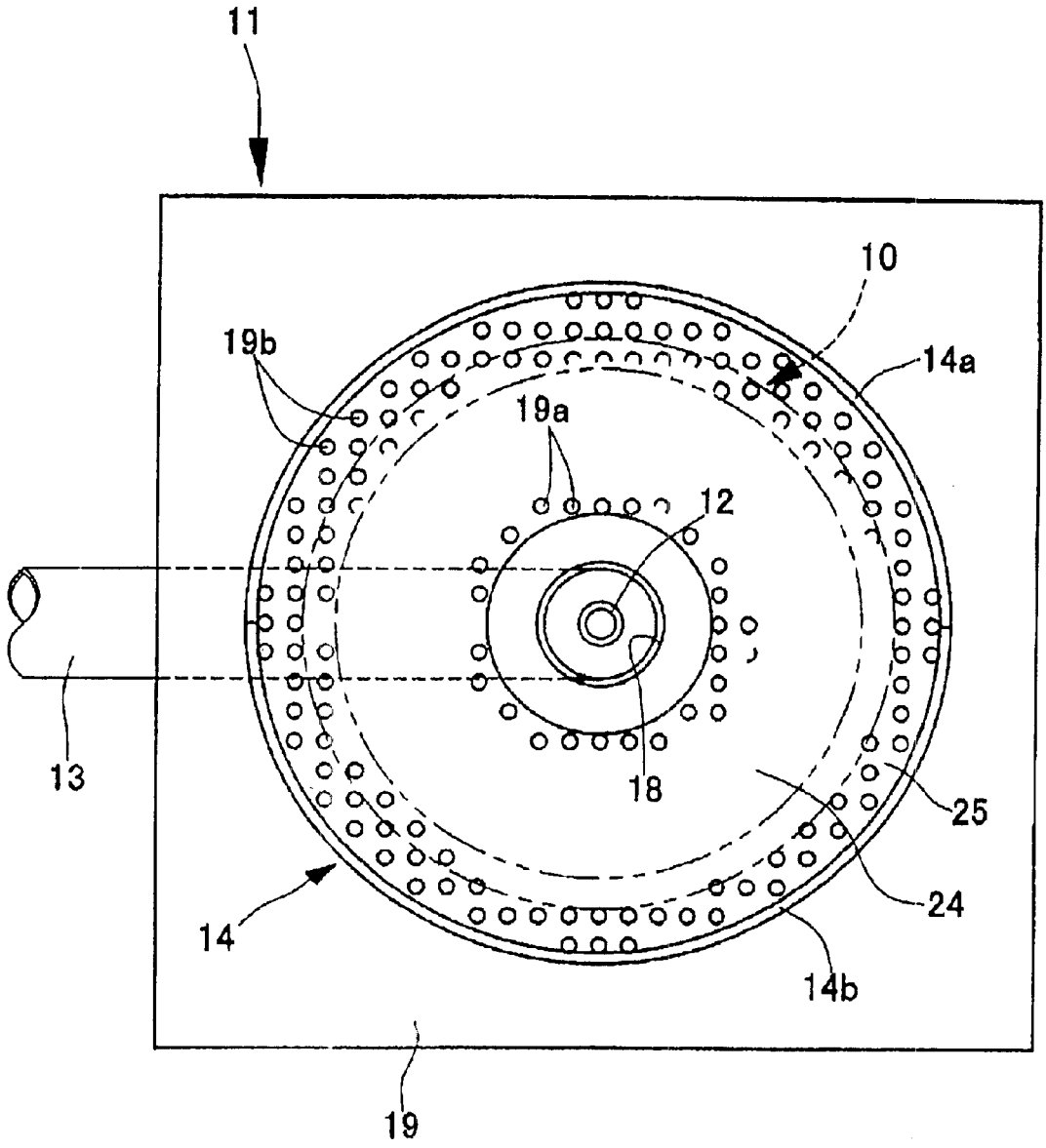
FIG. 2 is a plan view of the first embodiment.

FIG. 1 and FIG. 2 show a first embodiment of the gas supply apparatus of the present invention, with FIG. 1 depicting a cross-sectional front view and FIG. 2 depicting a plan view. This gas supply apparatus has an installation stand 11 on which the gas container 10 is placed, a heating medium spraying nozzle 12 that sprays heating medium towards the bottom surface of the gas container 10, a beating medium supply line 13 that supplies temperature-regulated heating medium to the heating medium spraying nozzle 12, and a container cover 14 having a pair of gutter-shaped bodies provided on the upper surface of the installation stand 11 so as to surround the gas container 10. The installation stand 11 is normally composed of the bottom plate section of a box referred to as a cylinder cabinet (not shown), and gas container 10 is removably housed within this cylinder cabinet.

Although the kind of liquefied gas stored in the gas container 10 is not limited in the present invention, it may be one of $WF_6$, $ClF_3$, $BCl_3$ and $SiH_2Cl_2$ used in the field of semiconductor production.

The installation stand 11 is formed by a horizontal gas container placement section 15 that supports the bottom section of the gas container 10, a load cell 16 in the form of a weighing device provided so as to support the outer peripheral section of the gas container placement section 15, and a pedestal section 17 located beneath the load cell 16 and installed on a floor surface and so forth. The heating medium supply line 13 is inserted into pedestal section 17 in the horizontal direction, rises between the load cell 16 by bending upward at the center section, is inserted into a circular through hole 18 provided in the center of the gas container placement section 15, and is provided with the heating medium spraying nozzle 12 on its end. Although one spraying nozzle 12 is provided in the present embodiment, two or more nozzles may be provided in the present invention. The inner diameter of this through hole 18 is formed to be larger than the outer diameter of the pipe 13 that forms the heating medium spraying nozzle 12 and the outer diameter of the heating medium spray nozzle 12, and the gas container placement section 15 supported by the load cell 16 is formed so as to be able to move up and down according to the change in weight of the gas container 10.

In addition, the gas container placement section 15 has a hollow section 23 surrounded by upper plate 19, a lower plate 20, an inner peripheral plate 21 and an outer peripheral plate 22, and a porous plate having a large number of through holes 19*a* and 19*b* is used for the upper plate 19. Thus, a space 24 between the bottom surface of the gas container the and upper surface of the installation stand is continuous with the hollow section 23 by the through holes 19*a* in the inner periphery of the upper plate 19, and the hollow section 23 is continuous with the space 25 between the outer periphery of the gas container 10 and the inner periphery of the container cover 14 by the through holes 19*b* in the outer periphery of the upper plate 19.

Namely, as shown by an arrow A in FIG. 1, the heating medium that has been sprayed at a high speed from the heating medium spraying nozzle 12 towards the bottom surface of the gas container 10 heats or cools the bottom surface of the gas container 10, after which, as shown with an arrow B, it flows from the space 24 between the bottom surface of the gas container 10 and the upper surface of the installation stand to the hollow section 23 through the through holes 19*a* on the inner peripheral side of the upper plate, and is then discharged to the space 25 in the inner periphery of the container cover 14 through the through holes 19*b* on the outer peripheral side of the upper plate 19 to form a heating medium discharge path (arrow B) that discharges the heating medium from the space 24 of the bottom surface section of the gas container 10 to the space 25 in the inner periphery of the container cover 14 after passing through the hollow section 23.

Although a gas like air or nitrogen is normally used for the heating medium, a liquid such as water may also be used as necessary. This heating medium is supplied to the heating medium supply line 13 by a blower or pump in a state in which, together with being regulated to a suitable temperature with a temperature regulating device not shown, is regulated to a suitable flow rate by a flow rate regulating device.

A commonly known heating device or cooling device may be used for the temperature regulating device, and for example, a heat exchanger exchanging heat with hot water and so forth or an electric heater can be used for heating, while heat exchange with cold water or low-temperature gas can be used for cooling. In addition, heating and cooling using a Peltier element can also be used. In addition, in the case of using, for example, a heater, control of temperature regulation may be simple ON-OFF control, several stages of ON-OFF control or continuous temperature control.

The load cell 16 is for monitoring changes in the weight of the gas container 10 through the gas container placement section 15, and that of any arbitrary shape can be used provided it does not have an effect on installation of the heating medium supply line 13. For example, that formed into the shape of a ring may be used, and a plurality of load cells of a suitable shape can be arranged at suitable locations of the gas container placement section 15. The reference symbol 16*a* in FIG. 1 indicates a signal line of load cell 16.

Although the container cover 14 may also be formed so as to surround the entire gas container 10 in the direction of height, even if a container cover 14 is provided of a height that surrounds about one-fifth of the gas container 10 from below, since the heating medium discharged from the bottom surface section of the gas container 10 can still be made to rise along the side wall of the gas container 10, the efficiency of heat transfer can be improved as compared with the case of not providing the container cover 14.

A gas supply apparatus formed in this manner is able to efficiently regulate the temperature of liquefied gas within the gas container 10 since the bottom section of the gas container 10 is heated or cooled by a heating medium. In particular, since the heating medium is sprayed at high speed by the heating medium spraying nozzle 12, the heating efficiency and cooling efficiency of the bottom section of the gas container 10 can be improved.

In addition, as a result of providing container cover 14, heating or cooling can also be performed from the side wall of the gas container 10, thereby making it possible to further improve the efficiency of heat transfer. Moreover, as a result of forming container cover 14 which can be divided into two halves consisting of stationary rear section 14*a* and removable or opening and closing front section 14*b*, the work of replacing the gas container 10 can be performed easily.

Figure 3:
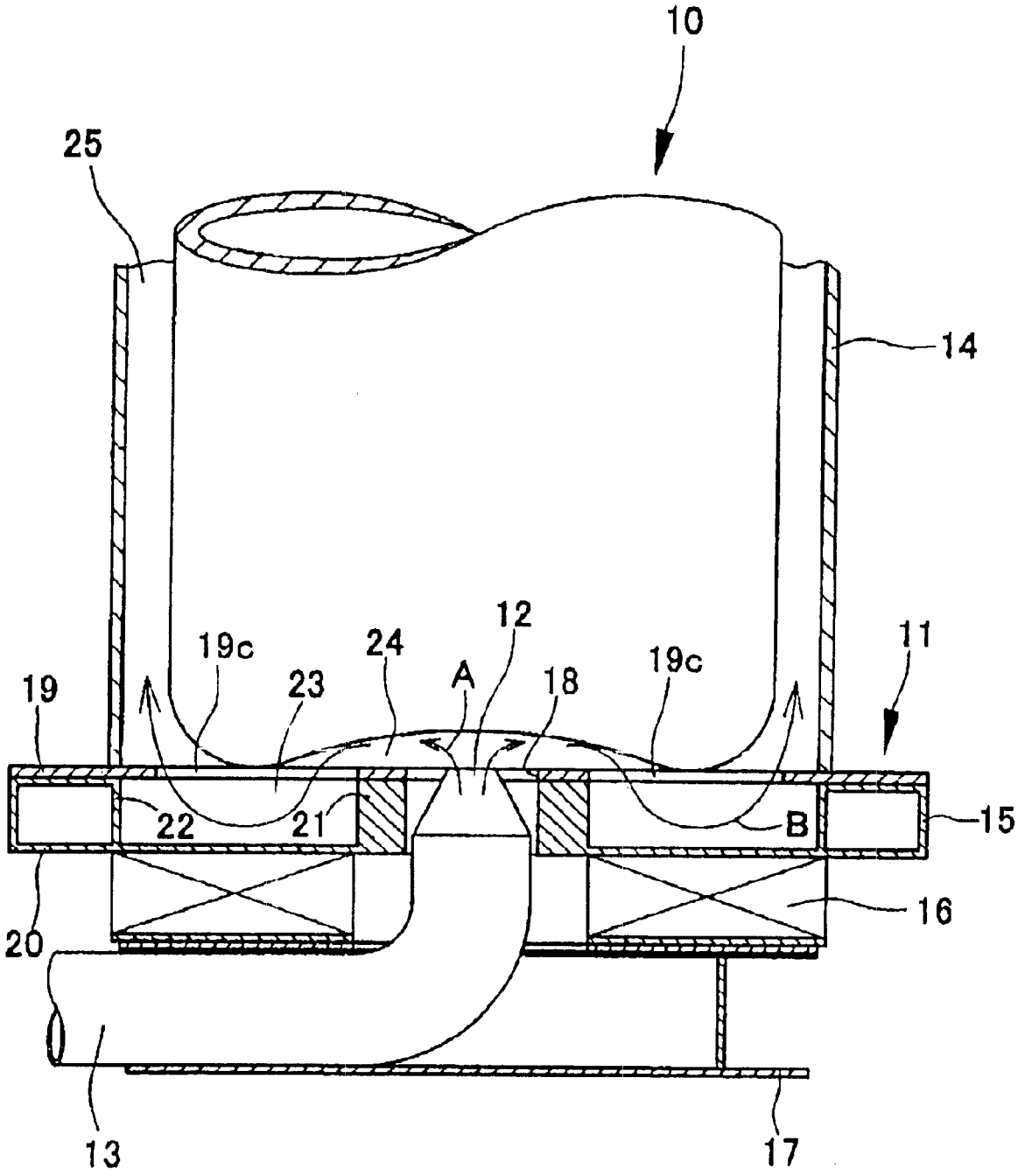
FIG. 3 is a cross-sectional front view showing a second embodiment of the gas supply apparatus of the present invention.
Figure 4:
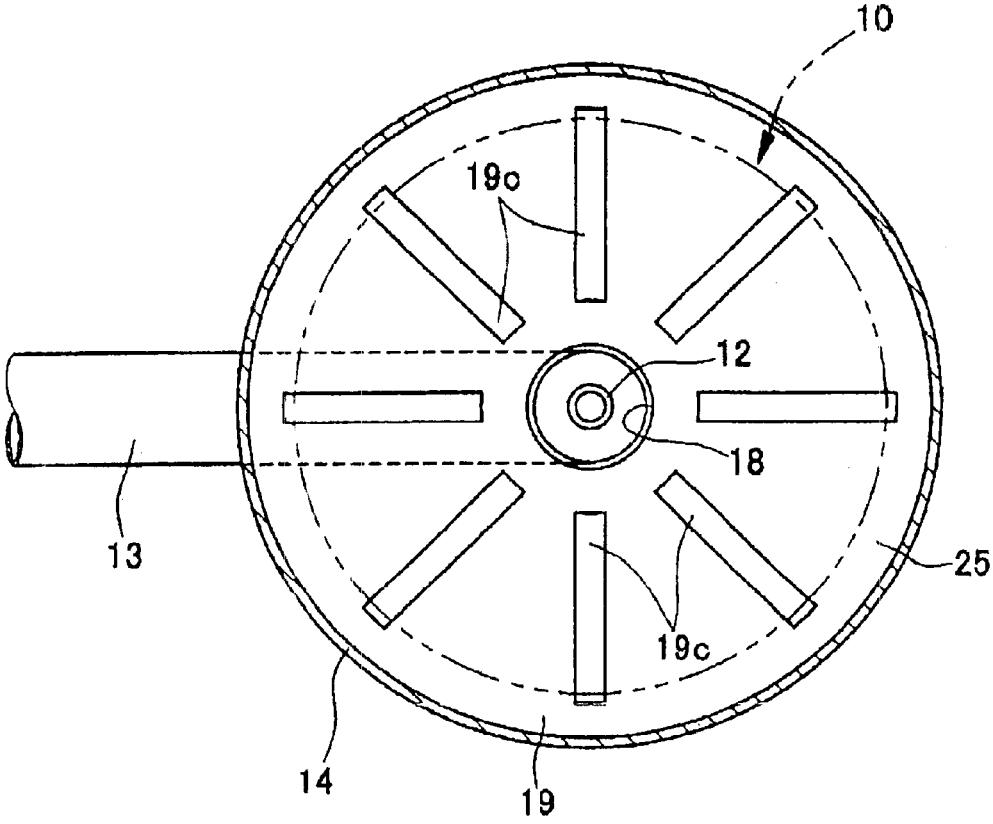
FIG. 4 is a cross-sectional plan view of the same.

FIGS. 3 and 4 indicate a second embodiment of the gas supply apparatus of the present invention, with FIG. 3 depicting a cross-sectional front view, and FIG. 4 depicting a cross-sectional plan view. Furthermore, those constituent features that are the same as the constituent features of the gas supply apparatus described in the first embodiment are indicated with the same reference symbols, and their detailed explanation is omitted.

The present embodiment has a plurality of radiating slits 19*c* formed in upper plate 19 in the gas container placement section 15, and these slits 19*c* are used as a heating medium discharge path. Namely, as indicated with arrow A in FIG. 3, the heating medium sprayed from the heating medium spraying nozzle 12 towards the bottom surface of the gas container 10 cools or heats gas container 10, after which, as indicated with arrow B, it flows from the space 24 between the bottom surface of the gas container 10 and the upper surface of the installation stand to the hollow section 23 through the inner peripheral side of the slits 19*c*, and is then discharged to the space 25 of the inner periphery of the container cover 14 through the outer peripheral side of the slits 19*c*.

Figure 5:
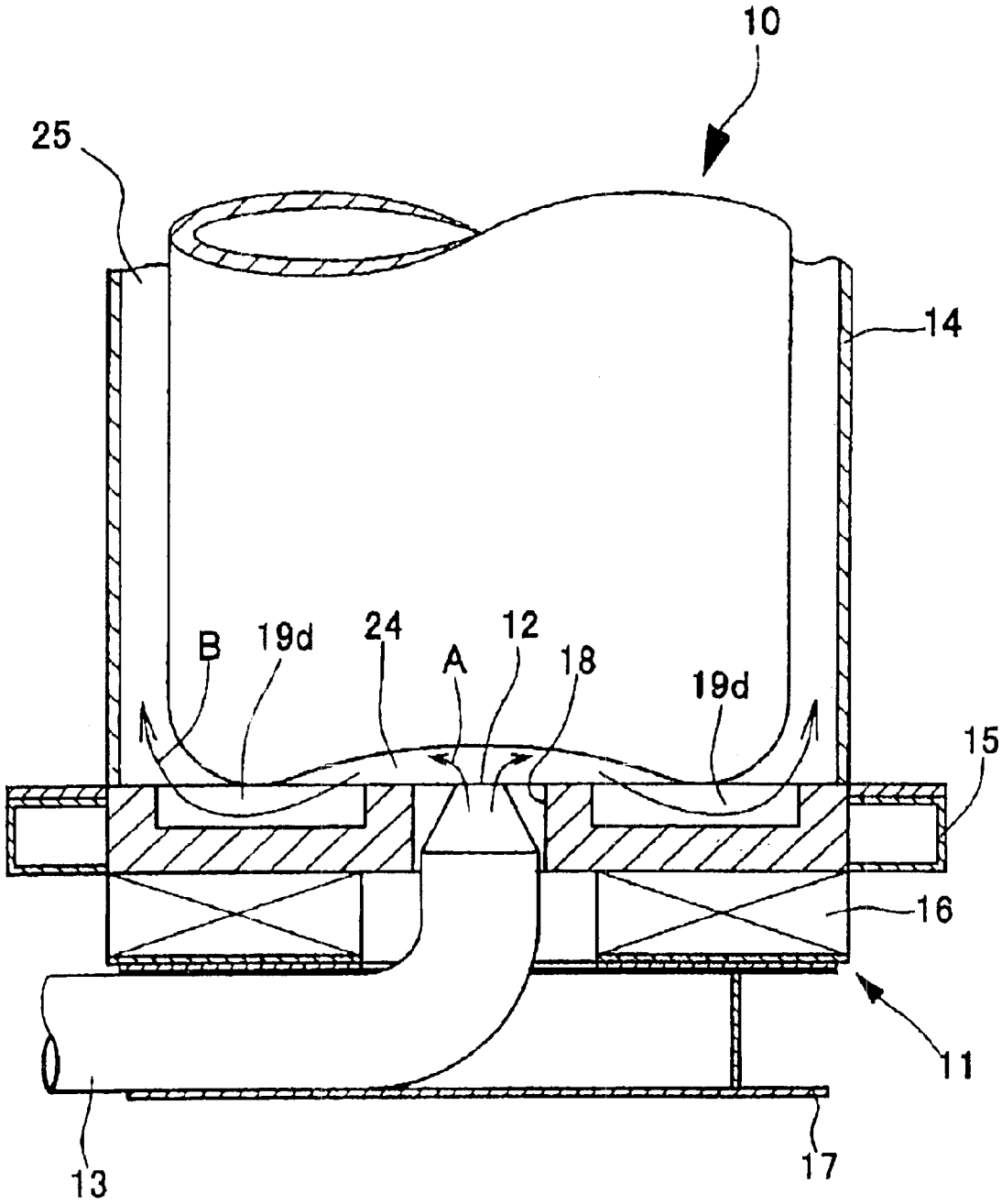
FIG. 5 is a cross-sectional front view showing a third embodiment of the gas supply apparatus of the present invention.

FIG. 5 is a cross-sectional front view showing a third embodiment of the gas supply apparatus of the present invention. In this embodiment, together with forming the inner peripheral section of container cover 14 in the gas container placement section 15 with a thick plate, a plurality of concave grooves 19*d* arranged in a radiating pattern in the same manner as the slits in the second embodiment are formed in the upper surface of the thick plate, and these concave grooves 19*d* are used as a heating medium discharge path. Namely, as indicated with an arrow A of FIG. 5, heating medium sprayed from the heating medium spraying nozzle 12 towards the bottom surface of the gas container 10 heats or cools the gas container 10, after which, as indicated with arrow B, passes through the inner peripheral side of the concave grooves 19*d* from the space 24 between the bottom surface of the gas container 10 and the upper surface of the installation stand, and is then discharged into the space 25 of the inner periphery of the container cover 14 by escaping from inside the grooves of the concave grooves 19*d* to the outer peripheral side.

In the present embodiment, although the concave grooves 19*d* that serve as the heating medium discharge path are formed in the upper surface of a thick plate, similar effects are obtained if a thin corrugated plate in which surface irregularities are formed continuously is used for the upper plate 19. In addition, the direction of the grooves is not limited to a radiating pattern, but are only required to allow heating medium to be discharged from the space 24.

Figure 6:
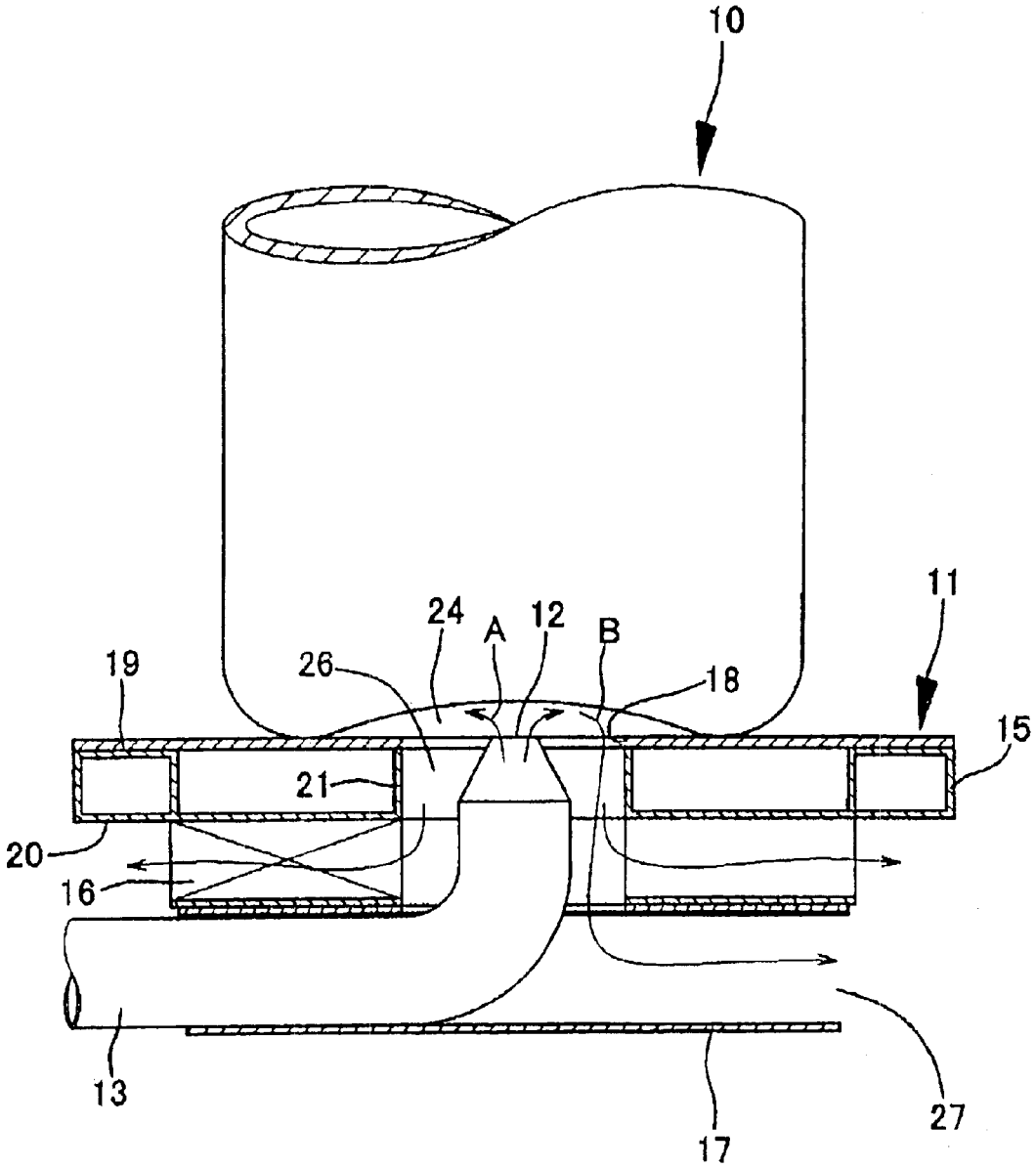
FIG. 6 is a cross-sectional front view showing a fourth embodiment of the gas supply apparatus of the present invention.

FIG. 6 is a cross-sectional front view showing a fourth embodiment of the gas supply apparatus of the present invention. In this embodiment, the heating medium discharge path 26 is formed in which the diameter of the through hole 18 provided in the center of the gas container placement section 15 is increased, and heating medium is discharged from the space 24 between the bottom surface of the gas container 10 and the upper surface of the installation stand between the inner periphery of this through hole 18 and the outer periphery of the heating medium supply line 13 provided with the heating medium spraying nozzle 12. Namely, as indicated by an arrow A of FIG. 6, heating medium that has been sprayed from the heating medium spraying nozzle 12 towards the bottom surface of the gas container 10 heats or cools the gas container 10, after which it passes through the heating medium discharge path 26 from the space between the bottom surface of the gas container 10 and the upper surface of the installation stand, and in the case a plurality of the load cells 16 are installed at suitable intervals, passes between each load cell 16 and is then discharged to the outside through the discharge path 27 provided in the pedestal 17. Thus, an ordinary plate material is sued for the upper plate 19 in the present embodiment.

A commonly known gas container that is typically distributed may be used for the gas container 10, and in addition to a metal gas container having a bottom surface indented to the inside, a gas container may also be used in which the bottom surface is in the form of a hemispherical protrusion and has a skirt arranged around its periphery. Even if the height or diameter of such a container is different, it is capable of effectively regulating temperature by heating medium.

Next, the gas supply method of the present invention will be explained. The gas supply method can be performed using the above gas supply apparatus.

The gas supply method according to the first aspect of the present invention comprises the steps of: supplying a vaporized gas while heating or cooling a gas container into which liquefied gas has been filled by a heating medium; measuring the pressure and flow rate of the vaporized gas flowing out from the gas container; regulating the temperature of the heating medium based on the difference between the measured flow rate of the vaporized gas and a reference flow rate when the measured flow rate is outside an allowed range of flow rate fluctuation predetermined with respect to a reference flow rate, and regulating the temperature of the heating medium based on the difference between the measured pressure and a reference pressure when the measured flow rate is within the allowed range of flow rate fluctuation relative to the reference flow rate.

On the other hand, the gas supply method according to the second aspect of the present invention comprises the steps of: supplying a vaporized gas while heating or cooling a gas container into which liquefied gas has been filled by a heating medium; measuring the pressure and flow rate of the vaporized gas flowing out from the gas container; regulating the temperature of the heating medium based on the difference between the measured flow rate and a reference flow rate when the measured pressure is lower than a lower limit pressure predetermined with respect to a reference pressure, and regulating the temperature of the heating medium based on the difference between the measured pressure and a reference pressure when the measured pressure is equal to or greater than the lower limit pressure.

Figure 7:
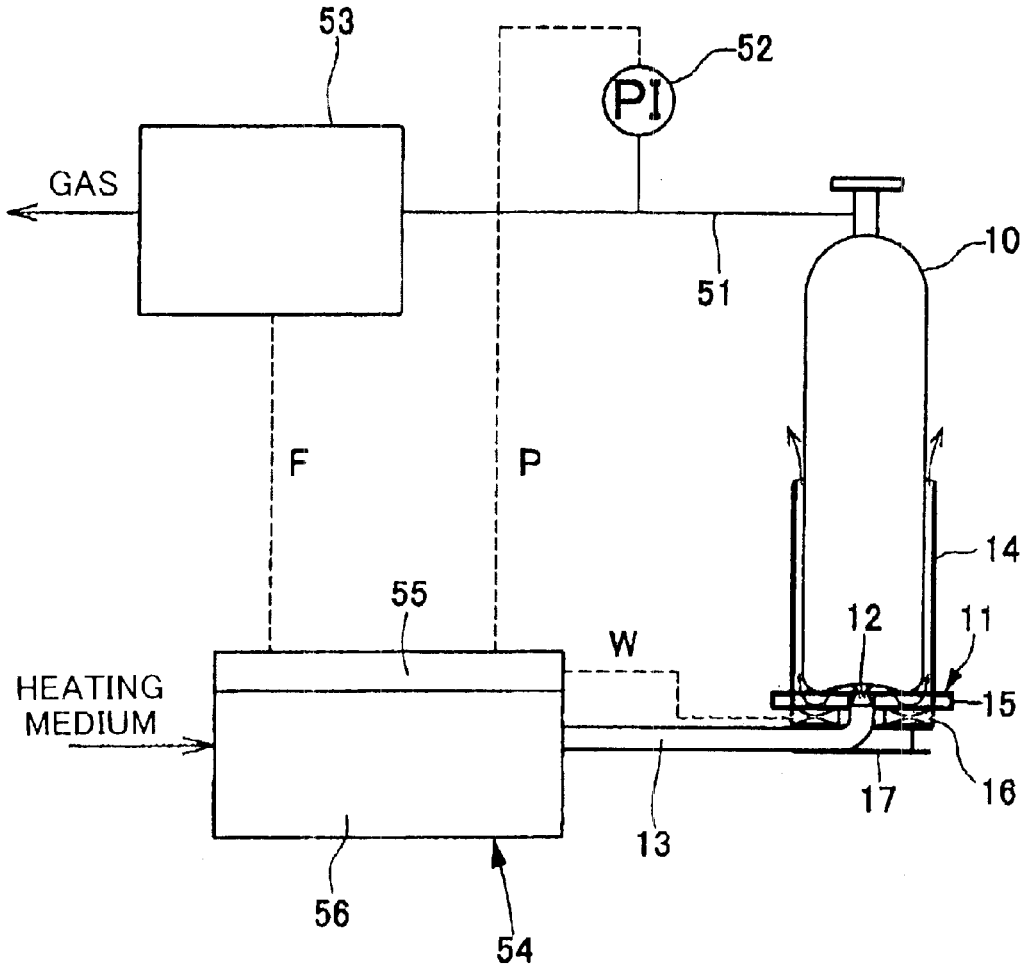
FIG. 7 is a schematic block diagram showing an embodiment of the method of the present invention.
Figure 8:
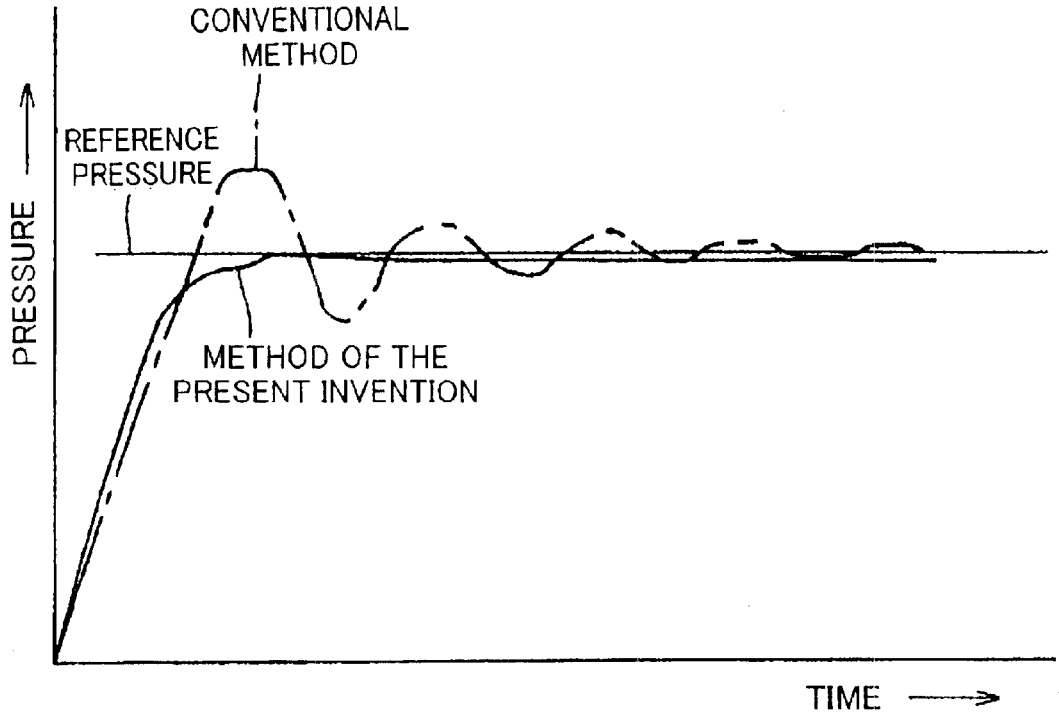
FIG. 8 is a graph showing the status of changes in pressure within a gas container for the method of the present invention and a method of the prior art.

FIGS. 7 and 8 shown an embodiment of the method of the present invention, with FIG. 7 being a schematic block drawing and FIG. 8 being a graph that shows the status of changes in pressure within the gas container 10 for the method of the present invention and a method of the prior art. The gas supply apparatus described in the first embodiment is used for the gas supply apparatus in FIG. 7.

A gas supply line 51 that supplies gas from the gas container 10 to an equipment that uses gas is provided with a pressure gauge (pressure sensor) 52 for measuring the pressure of the supplied gas, and a flow meter (mass flow meter) 53 for measuring flow rate, and pressure signal P and flow rate signal F measured by these, along with weight signal W measured with the load cell 16, are input into a control unit 55 in a pressure-temperature control apparatus 54. This control unit 55 regulates the temperature and supplied amount of the heating medium by a controlling heating medium temperature regulating device 56, while also monitoring the amount of remaining gas in the gas container 10 based on weight signal W from the load cell 16.

In the case that are no large fluctuations in the amount of gas consumed by the equipment using that gas, the temperature of the heating medium is controlled so that the gas pressure measured with the pressure gauge 52 is at a preset reference pressure, and by controlling the amount of heat by regulating the flow rate and pressure of the heating medium as necessary, control can be maintained sufficiently stable. Furthermore, the reference pressure is normally set to a fixed pressure corresponding to the type of gas, condition of the gas supply line and status of the equipment where the gas is used, etc.

On the other hand, in the case there are fluctuations in the amount of gas consumed at the equipment where the gas is used, the pressure inside the gas container 10 also gradually fluctuates accompanying fluctuations in the amount of gas supplied from the gas supply line 51, namely the amount of gas extracted from the gas container 10. For example, if the amount of supplied gas increases, since the amount of gas extracted from the gas container 10 increases in comparison with the amount of liquefied gas that evaporates inside the gas container 10, the amount of gas in the gas container 10 decreases and the pressure gradually decreases.

At this time, in contrast to the flow meter 53 being able to detect accurately when the flow rate has fluctuated, since the pressure gauge 52 measures a pressure that gradually fluctuates accompanying fluctuations in the flow rate, there are cases in which precise control becomes difficult. For example, if the flow rate increases from 1 liter per minute to 2 liters per minute, although the pressure inside gas container 10 gradually decreases, the decrease in pressure caused by this increase in flow rate is reflected in the measured value of pressure gauge 52 at a considerable time difference from the occurrence of the fluctuation in flow rate. In addition, a considerable time difference (control delay) also occurs from the occurrence of the fluctuation in flow rate until the heating medium temperature regulating device 56 raises the temperature of the heating medium, and this heated heating medium is heated to a temperature at which the required amount of evaporation is obtained for liquefied gas inside the gas container 10.

Consequently, in cases such as when there is a sudden increase in the amount of gas consumed, heating of liquefied gas is unable to be carried out precisely resulting in the risk of a decrease in the pressure of the supplied gas. On the other hand, in the case of a sudden decrease in gas flow rate, although it is necessary to lower the temperature of the heating medium and cool the liquefied gas, in this case as well, there is the risk of the gas pressure becoming abnormally high due to a control delay similar to that previously described, thereby resulting in problems such as having to set the design pressure in the gas supply line 51 and so forth to a higher pressure. At this time, although it becomes possible to control temperature more rapidly if the amount of pressure for which temperature of the heating medium is controlled due to pressure fluctuations is made to be smaller, in this case, heating and cooling of the heating medium must be switched frequently due to slight fluctuations in pressure or measurement error of the pressure gauge and so forth, thereby resulting in a loss of stability.

On the other hand, in the method of the present invention, control based on flow rate (flow rate control) is performed in addition to control based on pressure (pressure control). Namely, when the gas flow rate has increased, in order to secure an amount of evaporation of liquefied gas to match this, prior to control based on pressure, control is performed so as to regulate the heating temperature of the heating medium to a higher temperature to match the change in the flow rate.

For example, in the case the flow rate has increased from 100 ml per minute to 200 ml per minute, the heating medium temperature regulating device 56 performs control at the point this is detected, and the temperature of the heating medium is raised, for example, by 2° C. from the current temperature. As a result, since heating of the liquefied gas can be performed more rapidly than when the temperature of the heating medium is raised after detecting a decrease in pressure, pressure fluctuations can be reduced by suppressing decreases in pressure. At this time, in the case the pressure has reached a preset upper limit pressure according to conditions such as the amount of liquefied gas in the gas container 10, gas volume and atmospheric temperature, heating of the heating medium is interrupted by a signal from the pressure gauge 52.

In addition, in the case the flow rate has decreased from 200 ml per minute to 100 ml per minute, heating medium temperature regulating device 56 performs control at the point this is detected, and lowers the temperature of the heating medium by, for example, 2° C. from the current temperature. As a result, since the temperature of the liquefied gas can be lowered more rapidly than when the temperature of the heating medium is lowered after detecting an increase in pressure, the evaporated amount of liquefied gas inside the gas container 10 can be decreased corresponding to the decrease in flow rate, and fluctuations in pressure can be reduced by suppressing rises in pressure.

The degree of temperature regulation of the heating medium with respect to the amount of fluctuation in the flow rate varies according to the conditions of the equipment that uses gas in which the gas supply apparatus is installed and so forth, and this varies not only depending on the amount of fluctuation in the amount of gas consumed, but also, for example, on the air temperature at the installation site, while also varying according to the size and material of the gas container 10. As a simple device of control, together with using the average amount of gas consumed by equipment using the gas as the reference flow rate, the temperature of the heating medium for satisfying this reference flow rate is set as the reference temperature, and in the case the measured gas flow rate increases with respect to the reference flow rate, the temperature of the heating medium may be raised, while in the case the gas flow rate decreases with respect to the reference flow rate, the temperature of the heating medium may be lowered. For example, in the case the reference flow rate is 100 ml per minute and the reference temperature is 23° C., the effect of alleviating pressure fluctuations as described above is obtained even by controlling so that the temperature of the heating medium becomes 25° C. when the measured flow rate reaches 200 ml per minute, and the temperature of the heating medium becomes 20° C. when the measured flow rate reaches 50 ml per minute.

In cases in which fluctuations in the flow rate of the equipment that uses the gas occur frequently, stability can be improved by reducing the burden on heating medium temperature regulating device 56 by storing the premeasured flow rate in memory, setting the flow rate immediately before the measured flow rate fluctuated (pre-fluctuation flow rate) as a second reference flow rate (second reference flow rate), comparing this second reference flow rate with the measured flow rate, and regulating the heating medium temperature when it has exceeded a fixed range without regulating the heating medium temperature when the amount of the flow rate fluctuation is within the range of the allowed amount of flow rate fluctuation.

In this case, when the gas flow rate gradually increases or decreases in a stepwise manner, since the second reference flow rate that is the immediately prior flow rate also changes in a stepwise manner, it is difficult to perform precise control by comparing with this second reference flow rate alone. Thus, in such cases, the basic reference flow rate (first reference flow rate) may either added to the comparison control, or a suitable flow rate such as the flow rate when the measured flow rate first fluctuated or the average flow rate for one hour prior or the previous day may be set as a third reference flow rate (third reference flow rate), and control may then be performed by comparing each of these reference flow rates and the measured flow rate based on their differences. Moreover, control may also be set so as to perform temperature control compatible with slight fluctuations in flow rate by suitably combining comparative control, differential control or integral control based on the amount of change in the flow rate and the conditions under which fluctuations in flow rate occur.

Furthermore, in any case, when gas pressure has fallen below a preset lower limit pressure with respect to the reference pressure, the apparatus is operated so that the pressure is maintained at the reference pressure by raising the temperature of the heating medium regardless of the flow rate measured value, and increasing the amount of evaporation of liquefied gas. Temperature can be controlled more accurately by controlling the temperature of the heating medium by measuring not only the temperature with heating medium temperature regulating device 56, but also the temperature of the heating medium when discharged from the heating medium discharge path.

On the other hand, in the case the gas pressure measured with pressure gauge 52 is lower than the lower limit pressure when gas is initially supplied after replacing the gas container 10, in the case of the control, control is performed based on pressure and the state is such that there is a large difference between the reference pressure and the measured pressure, the heating medium is heated at the maximum heating capacity of heating medium temperature regulating device 56. In this case, however, if heating of the heating medium is discontinued only after the measured pressure has reached the reference pressure, the temperature of the liquefied gas is not lower than the optimum temperature and the amount of evaporation continues to a certain extent in an excess state, thereby resulting in the pressure becoming excessively high. Moreover, under conditions in which there are hardly any fluctuations in flow rate, and particular when there are hardly any decreases in flow rate, since control is also performed based on flow rate as described above, a long time is required until the pressure settles to the vicinity of the reference pressure.

In such cases, in the method of the present invention, when the gas pressure measured with the pressure gauge 52 is lower than the lower limit pressure, control is performed based on flow rate. Namely, the first reference flow rate, third reference flow rate or flow rate prior to replacing the gas container 10 are set as a control reference flow rate, and heating medium temperature regulating device 56 is controlled so that the gas supply flow rate measured with flow meter 53 reaches a flow rate that approaches these reference flow rates. In this case as well, in the case of an intermediate fluctuation in flow rate, control is performed that is similar to the control based on fluctuations in flow rate as previously described.

After the measured pressure has exceeded the lower limit pressure, this control based on flow rate is discontinued, heating of the heating medium is interrupted and the heating medium temperature regulating device 56 is controlled so that the temperature of the heating medium becomes the preset heating medium temperature. Subsequently, heating medium temperature regulating device 56 is controlled by combining the flow rate control and pressure control.

In this manner, by controlling flow rate during the initial supply of gas, and controlling the heating state of the heating medium by combining flow rate control and pressure control after the pressure has exceeded the lower limit pressure, as shown in FIG. 8, the method of the present invention is able to stabilize the pressure in a short period of time in the vicinity of the preset pressure corresponding to various conditions such as the type of gas and volume of the gas container 10 in comparison with conventional control based only on pressure (method of the prior art), thereby making it possible to rapidly begin the stable supply of gas.

In addition, as was previously mentioned, since the remaining amount of liquefied gas in the gas container 10 can be accurately monitored by measuring the weight of the gas container 10 by installing the load cell 16, when the amount of liquefied gas has fallen below a defined value, together with it being possible to prevent abnormal rises in pressure due by interrupting heating of the heating medium, the time for replacing the gas container 10 can be accurately determined by displaying this information with a suitable display device, thereby allowing the efficiency of use of liquefied gas filled into the gas container 10 to be improved.

As has been previously explained, according to the present invention, since liquefied gas filled into a gas container can be supplied by evaporating and vaporizing the liquefied gas efficiently, and the supply pressure can be stabilized, gas supply can be carried out in a stable state.

What is claimed is:

1. A gas supply apparatus which supplies a gas by vaporizing a liquefied gas filled in a gas container, comprising:

an installation stand having an upper surface on which the gas container is placed;

at least one nozzle which discharges a heating medium towards a bottom surface of the gas container and is provided in a hole formed in the installation stand; and a heating medium discharge path which discharges the heating medium from a space between the bottom surface of the gas container and the upper surface of the installation stands, wherein the heating medium discharge path comprises a plurality of radiating slits or radiating grooves formed in the installation stand.

2. The gas supply apparatus according to claim 1, further comprising a cylindrical cover that covers the periphery of the gas container, wherein the heating medium discharge path is formed so that heating medium discharged from the nozzle flows into a gap between the gas container and the cylindrical cover.

3. The gas supply apparatus according to claim 1, wherein the installation stand is supported by a weighing device capable of measuring changes in the weight of the gas container, and the nozzle is provided in a non-contact state with respect to the installation stand.

4. The gas supply apparatus according to claim 1, further comprising:

a pressure measuring device which measures the pressure of gas supplied from the gas container;

a flow rate measuring device which measures the flow rate of the gas; and a temperature regulating device which regulates the temperature of the heating medium based on measured values of the pressure measuring device and the flow rate measuring device.

* * * * *